United States Patent [19]

McDonald et al.

[11] 4,129,911

[45] Dec. 19, 1978

[54] SOFT DECK SURFBOARD

[76] Inventors: Michael D. McDonald, 960 Scott St.; Stanley A. Pleskunas, 3725 Pio Pico St., both of San Diego, Calif. 92106

[21] Appl. No.: 770,438

[22] Filed: Feb. 22, 1977

[51] Int. Cl.[2] ..... A63C 5/00; A63C 9/00; A63C 11/00; A63C 15/00

[52] U.S. Cl. ..... 9/310 E; 9/1.7; 9/6 P

[58] Field of Search ..... 9/1.1, 1.3, 1.7, 3, 9/310 R, 310 B, 310 E, 310 F, 310 G, 310 J, 348, 6 R, 6 P; 114/68

[56] References Cited

U.S. PATENT DOCUMENTS

| | | | |
|---|---|---|---|
| 1,829,471 | 10/1931 | Brimhall | 9/310 B |
| 3,323,154 | 6/1967 | Lambach | 9/310 E |
| 3,380,090 | 4/1968 | Kenmuir | 9/310 B |
| 3,543,315 | 12/1970 | Hoffman | 9/310 |
| 3,657,753 | 4/1972 | Le Blanc | 9/310 F |
| 3,929,549 | 12/1975 | Smith | 9/310 E |
| 4,006,503 | 2/1977 | Wood | 9/13 |

*Primary Examiner*—Trygve M. Blix
*Assistant Examiner*—D. W. Keen
*Attorney, Agent, or Firm*—Ralph S. Branscomb

[57] ABSTRACT

A surfboard is constructed to have a soft deck by forming a lower body of a rigid foam material covered with a fiberglass resin coating and forming a deck insert of resilient foam material secured to the deck of the lower body and covered by a flexible impervious covering. The method of making the surfboard includes the shaping and covering of the lower body, the shaping and application to the upper deck of a resilient foam material and the covering of the foam material with a flexible impervious cover.

10 Claims, 11 Drawing Figures

SHAPE SURFBOARD BLANK.

INSERT DECK MATERIAL AND PRESS INTO CAVITY.

CUT DECK CAVITY.

SHAPE DECK MATERIAL.

APPLY FIBERGLASS LAMINATE.

APPLY DECK COVERING.

SOFT DECK SURFBOARD

BACKGROUND OF THE INVENTION

The present invention relates to surfboards and pertains particularly to a surfboard having a soft deck and to a method of making same.

Surfing is a popular sport in many major countries of the world. Surfboards are typically constructed of a body of buoyant material such as foam plastic covered by a hard skin such as fiberglass and resin. Such boards can be shaped and polished to be highly efficient.

One problem with such boards, however, is that the hard deck thereof is uncomfortable on the knees of the surfer when paddling out to catch a wave and can become very slick in use. Also such boards are subject to dings or dents which break the surface upon impact with other boards or objects. Also such boards are capable of being designed to provide only a limited amount of flex.

Accordingly it is desirable that an improved surfboard be available which includes a soft deck, is ding resistant, and also includes improved flexing.

SUMMARY AND OBJECTS OF THE INVENTION

Accordingly it is the primary object of the present invention to overcome the above problems of the prior art.

Another object of the present invention is to provide a surfboard having a soft deck.

A further object of the present invention is to provide a surfboard having a ding resistant deck.

Still another object of the present invention is to provide a surfboard having improved flexing characteristics.

Still a further object of the present invention is to provide an improved surfboard having a soft deck with improved ding resistance, improved flexibility and at the same time retain the efficiency of the hard skinned surfboards.

In accordance with the primary aspects of the present invention, a surfboard consists of a lower buoyant body covered by a hard skin and an upper deck thereof formed by a body of resilient material and having an impervious outer surface. The surfboard is constructed in the preferred embodiment by selecting and shaping a first surfboard blank, forming a deck cavity, applying a fiber glass laminate to the first body, attaching an upper body, shaping the deck, and thereafter applying a deck covering.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
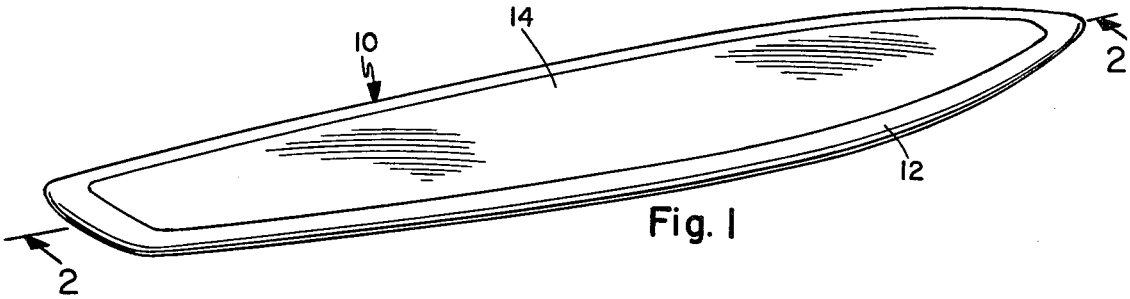
FIG. 1 is a perspective view of a surfboard in accordance with the invention.
Figure 2:
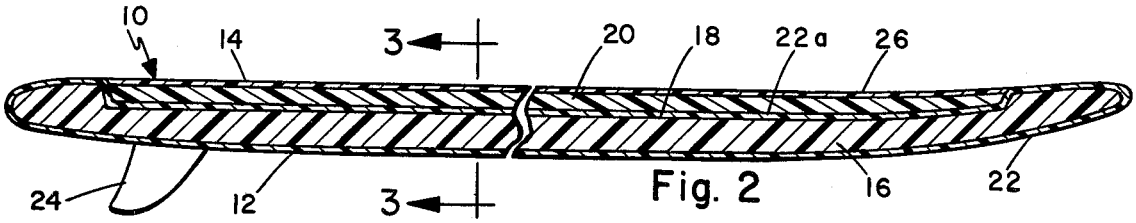
FIG. 2 is a sectional view taken on lines 2—2 of FIG. 1.
Figure 3:
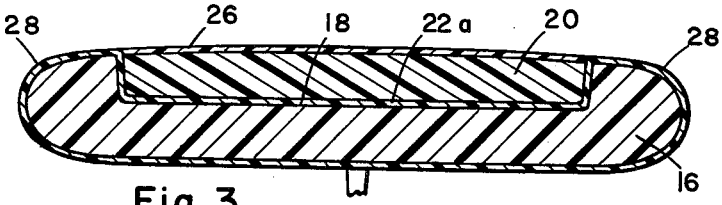
FIG. 3 is a sectional view taken on lines 3—3 of FIG. 2.

Turning now to the drawings, particularly to FIG. 1, there is illustrated a surfboard designated generally by the numeral 10 constructed in accordance with the present invention. The surfboard comprises a lower or main body 12 having an upper soft or pliant deck 14. The board may have any suitable configuration to serve its purpose, the specific curvatures thereof not being a part of the present invention. The board is constructed to have the usual hard bottom and rail line but to have a soft upper surface or deck. The board comprises a main or lower body 16 which is constructed of a suitable lightweight strong flotation material such as a plastic foam, with polyurethane being preferred. A blank of such materials, such as polyurethane is selected and shaped to the desired board configuration. The rails and rocker are shaped to the desired configuration and the overall board to desired thickness. The deck is then shaped for the soft deck insert or upper body member which is preferably of a suitable elastic foam material.

In the illustrated embodiment a cavity 18 is formed of the desired configuration and depth for receiving the upper body or insert of resilient material 20. The lower body member 16 is then covered with laminations of fiberglass cloth and polystyrene resin. Some models of the board may have to have one lamination of the bottom put on before shaping the deck.

A coating 22 of fiberglass and polystyrene resin is put on the lower body 16. The deck covering 22*a* in cavity 18 of the lower body 16 need only the single coating in the usual situation. This coating 22*a* is left rough, or it may be buffed to a rough finish for attachment of the soft body material 20. The bottom and rails are then finished with hot coats of polystyrene resin.

One or more fins 24 are mounted on the bottom of the board either above or below the hot coat. The bottom and rail coatings are finished, such as by sanding, gloss coating and buffing.

Thereafter the upper body 20 for the soft deck which is a suitable elastic foam material, such as polyethylene material, is then secured in place. This may be secured in place by a suitable adhesive such as a suitable contact cement. After suitable coats of contact cement are applied to the deck and the polyethylene blank, the blank is then put into the deck cavity and forced into place with pressure. After sufficient set up time to permit the cement to dry the deck body 20 is then shaped to the approximate deck curve desired. This can be done in any suitable manner, such as by hot wire. The deck may then be finally finished to its appropriate shape by sanding or the like.

The upper surface of the deck is then coated by a thin impervious sheet of flexible material such as a coating 26 of vinyl. The coating is sealed over the body 20 and to the fiberglass coating on the rails. The coating 26 may be applied in any suitable manner such as by spray or roller.

The depth of the cavity 18 for receiving the soft body of the deck 20 is, in any case, deep enough to receive the desired amount of material for the deck as a preferred construction. It is understood however, that the material may be laid over the deck and secured to the upper surface of a normally flat deck and preferably feathered out at the edges. However the construction as illustrated has two distinct advantages. The first advantage is that it permits the construction to provide hard side rails 28, which enhances the performance of the board. Another distinct advantage is that it permits the depth of the cut or cavity 18 to be varied and thereby control the flexibility of the board. For example, the lateral flex of the board can be modified by modifying the thickness of the board at the center or especially modifying the thickness of the body portion 16 through the center. This will enhance the flex of the board since the upper body member 20 is resilient and easily flexed. The stiffness of the board is obtained by the lower body member 16 and the outer shell or coating 22 thereof.

Figure 4:
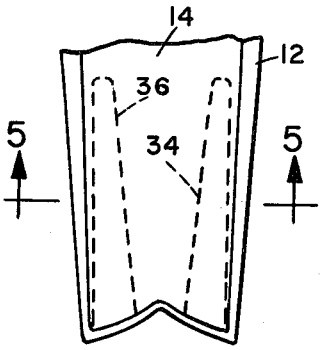
FIG. 4 is a partial top plan view showing an alternate embodiment of the invention.
Figure 5:
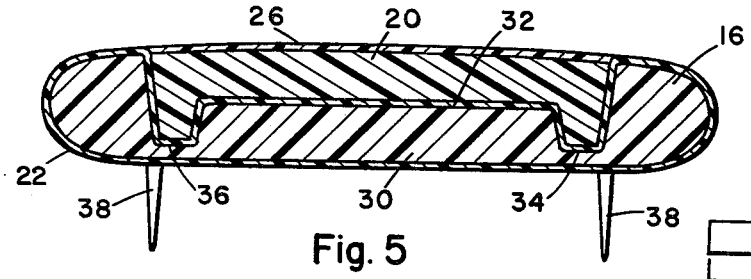
FIG. 5 is a sectional view taken generally on lines 5—5 of FIG. 4.
Figure 6A:
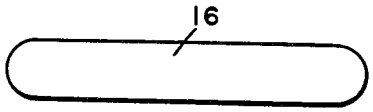
FIGS. 6*a* through 6*f* illustrate typical steps in carrying out the method of the invention.
Figure 6D:
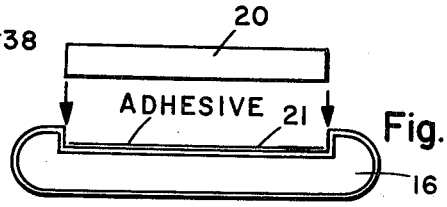
Figure 6B:
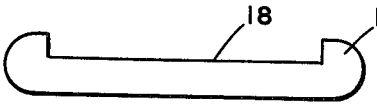
Figure 6E:
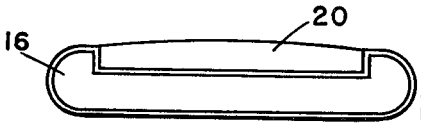
Figure 6C:
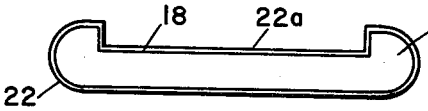
Figure 6F:
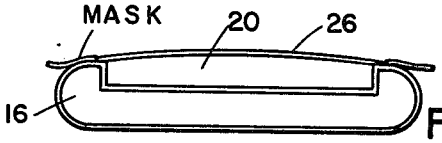

Referring now to FIGS. 4 and 5, other modifications of the body can be carried out to modify the flex of the board. For example, as shown in FIGS. 4 and 5, a body member 30 is shaped with a cavity 32 having grooves 34 and 36 at each side thereof. These grooves extend down part way, as shown in FIG. 4, along the rails. This increases the rail flex at the tail end of the board. These grooves may extend the entire length of the board if desired to extend the flexibility throughout the length of the board.

Additionally, other modifications may be made in this particular manner such as a single groove down the center, for example, running the entire length of the board.

Also, as illustrated in FIG. 5, a pair of fins 38 may be attached to the under side of the board. These fins may be attached outboard of the grooves 34 and 36 as illustrated, to participate in the flex of the board. On the other hand, it may be desirable for the fin or fins to be inboard of the grooves and not be subjected to any of the flex.

This surfboard construction provides a surfboard that has a usual surfboard performance having the usual hard bottom and rails and at the same time having a soft upper surface or deck which is at the same time ding resistant as well as more comfortable to ride. This construction also makes the board lighter because of the low density of the resilient foam material 20 placed in the upper body of the board.

Turning now to FIGS. 6*a* through 6*f*, the preferred method of the present invention is illustrated. The construction of a board in accordance with the preferred embodiment of this invention is carried out by the steps of first selecting a suitable blank of rigid foam material, shaping the blank into the desired basic board configuration 16, cutting a deck receiving cavity 18 as desired, applying fiberglass laminate 22 to the shaped body. The step of applying the fiberglass may be carried out in some instances before the step of cutting the deck cavity and may be carried out to various degrees such as complete finishing of the underside and rails or these steps may be reserved until later.

The deck 20 of the board is completed by selecting a suitable resilient foam material such as a polyethylene foam. This block of material is shaped to fit the cavity 18 and is attached in place by applying a suitable adhesive 21, such as contact cement, to either one or both of the deck 20 and the surface of the deck covering 22*a* in cavity 18. The deck surface or covering 22*a* may be roughened if desired or necessary to obtain the necessary adhesion.

Thereafter, shaping of the deck is carried out by cutting away the excess portion of the deck 20 in a suitable manner such as by a hot wire. Thereafter the deck is shaped into its final desired configuration and the step of applying the deck covering is carried out.

The deck is covered such as by masking off the rails and applying a coat of vinyl 26 to the upper surface of the body 20 in a suitable manner, such as by roller or spraying. A suitable number of coatings may be applied with the masking removed after each application of the coating.

Alternate methods of constructing the board are also possible, such as forming a fiberglass and resin shell of the desired configuration and filling the shell with a suitable foam by blowing or injecting it into the shell. The foam can be either a hard foam or a soft (i.e., flexible) foam. The shell may also be filled by shaping the foam blank and putting it in a heat mold, for final sizing and shaping, then cutting the shell across either one or both ends and putting the foam inside.

The shells can be made by mass production techniques of molding in either one or two pieces. The inner foam can be a soft or resilient foam such as polyethylene foam. This makes a lighter and cheaper board than prior art techniques. In addition, this technique permits control of the flexibility of the board.

The soft deck may be applied as above described or by mass production techniques.

The board thus obtained provides a unique construction having numerous advantages in addition to those previously discussed. The board is more buoyant and has a lower center of gravity than prior art boards. The greater buoyancy characteristics permits an individual of a given size and weight to use a smaller and lighter board and obtain the same support as with larger prior art boards. The lower center of gravity gives the board greater stability than those of the prior art.

The soft deck gives a surfer better grip of the board and thereby better control. His feet will sink into the surface to a degree so that he does not rely solely on friction between feet and surface as with conventional hard deck boards. This eliminates the need for waxing the deck to increase friction as in prior art boards.

While the present invention has been described and illustrated by means of specific embodiments it is to be understood that numerous changes and modifications may be made therein without departing from the spirit and scope of the invention as defined in the appended claims.

Having described our invention, we now claim:

1. A soft deck surfboard comprising:

(a) a lower body including:

(i) a core having a general outward surfboard configuration defining an upper surface, a bottom surface and a pair of side rails; and (ii) a smooth, hardened impervious shell covering at least the bottom surface and rails of said core to provide said surfboard with generally rigid control surfaces and low-drag characteristics in its water-contacting surfaces; and (b) an upper body comprising a yielding, resilient foam pad secured to the top of said lower body and covering a substantial portion of same to define a soft, tractable deck to enhance the comfort and stability of a surfer using said surfboard in both the kneeling and standing mode; and (c) the upper surface of said lower body being relieved to define a longitudinally extended cavity, and said upper body fitting within said cavity to define a deep yielding deck and is contoured to define a continuous, smooth transition to the contiguous cavity-defining portions of the upper surface of said lower body.

2. A surfboard according to claim 1 wherein said foam pad is at least three-eights of an inch thick at its thickest point to provide the proper flotation flexibility and ensure a suitably soft gripping surface.

3. A surfboard according to claim 1 wherein said cavity is of transverse dimension short of the rail separation distance, and said rails have top, side-edge, and bottom portions covered with said hardened impervious shell providing said surfboard with maximum maneuverability control and minimum drag during maneuvers together with soft-deck comfort and stability.

4. A surfboard according to claim 1 including at least one generally longitudinally extended groove sunk into the material of said core to weaken same along said groove to generally define a preferential flex line along which said surfboard flexes in use to achieve desirable hydro-dynamic characteristics.

5. A surfboard according to claim 1 and including a pair of spaced longitudinal grooves substantially parallel and adjacent to said rails, respectively, and defined in the rear portion of said surfboard, to provide said rails with increased independent rear flex capability.

6. A surfboard according to claim 5 wherein said upper body extends into and fills said grooves to define regional thicknesses in said upper body at the groove areas of more than half of the total surfboard thickness.

7. A surfboard according to claim 5 wherein said grooves are transversely expanded progressively toward the rear of said surfboard to provide same with a graduated, increasing flex capability toward the rear.

8. A surfboard according to claim 1 wherein the thickness of said upper body is on the order of one half the total thickness of the surfboard to maximize the effectiveness of said upper body while maintaining adequate lower body strength.

9. A surfboard according to claim 1 wherein said impervious shell is completely integral and continuous and encapsulates said core in its entirety.

10. A surfboard according to claim 1 and including a flexible impervious coating covering said deck and being sealed to said impervious shell around said deck such that said coating and shell define a continuous water-tight enclosure encapsulating said surfboard.

* * * * *